US006318001B1

(12) United States Patent
Lee

(10) Patent No.: US 6,318,001 B1
(45) Date of Patent: Nov. 20, 2001

(54) SPRINGY SPORTS SHOE

(76) Inventor: Yan-Yee Lee, 16, Lane 667, Chung Shang Road, Sir Nan Village, Sun Kang Hsiang Taichung Hsien (TW)

( * ) Notice: Subject to any disclaimer, the term of this patent is extended or adjusted under 35 U.S.C. 154(b) by 0 days.

(21) Appl. No.: 09/620,712

(22) Filed: Jul. 20, 2000

(51) Int. Cl.[7] ..... A43B 13/28

(52) U.S. Cl. ..... 36/27; 36/7.8; 482/77; 482/79

(58) Field of Search ..... 36/27, 7.8; 482/77, 482/79

(56) References Cited

U.S. PATENT DOCUMENTS 1,638,350 * 8/1927 Long ..... 36/7.8
3,219,358 * 11/1965 Hagner ..... 280/11.4
3,377,722 * 4/1968 Downing ..... 36/7.8
4,492,374 * 1/1985 Lekhtman et al. ..... 482/77
5,205,798 * 4/1993 Lekhtman ..... 482/77
5,643,148 * 7/1997 Naville ..... 482/77
5,701,685 * 12/1997 Pezza ..... 36/7.8
5,916,071 * 6/1999 Lee ..... 482/77

* cited by examiner

*Primary Examiner*—Ted Kavanaugh
*Assistant Examiner*—Troy Arnold
(74) *Attorney, Agent, or Firm*—Harrison & Egbert

(57) ABSTRACT

A springy sports shoe includes a boot which is fastened in the sole to a springy body and an elastic body by a fastening body. The fastening body is formed of an upper body which is fastened to the sole the boot, and of a lower body which is fastened to the springy body. The elastic body is retained by the springy body.

1 Claim, 3 Drawing Sheets

SPRINGY SPORTS SHOE

BACKGROUND OF THE INVENTION

1. Field of the Invention

The present invention relates generally to a sports shoe, and more particularly to a springy sports shoe.

2. Description of Related Art

Most of the exercises and recreational activities are confined to a specific playground. Nowadays, people are often too busy to go to the playground to do the exercise or recreational activity. In addition, most of the modern exercise machines are so cumbersome that they take up a large area of the floor space, and they are expensive.

BRIEF SUMMARY OF THE INVENTION

The primary objective of the present invention is to provide a springy sports shoe which is intended for use in doing exercise in a small floor space.

It is another objective of the present invention to provide a springy sports shoe which is simple in construction and is cost-effective.

In keeping with the principle of the present invention, the foregoing objectives of the present invention are attained by a springy sports shoe comprising a boot and an elastic body fastened to the sole of the boot.

The foregoing objectives, features and advantages of the present invention will be more readily understood upon a thoughtful deliberation of the following detailed description of a preferred embodiment of the present invention with reference to the accompanying drawings.

BRIEF DESCRIPTION OF THE GENERAL VIEWS OF THE DRAWINGS

DETAILED DESCRIPTION OF THE INVENTION

Figure 1:
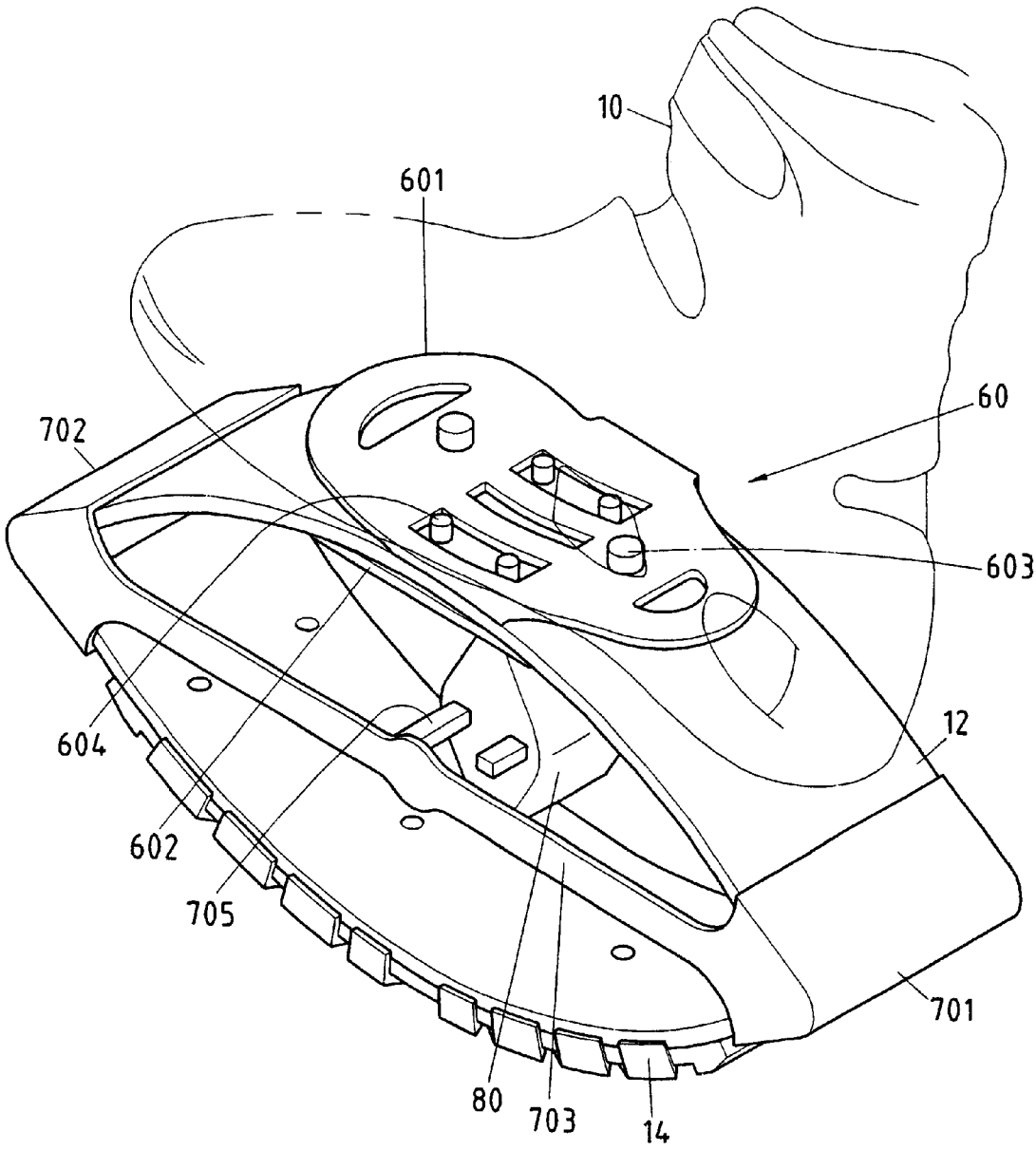
FIG. 1 shows a perspective view of the preferred embodiment of the present invention.
Figure 2:
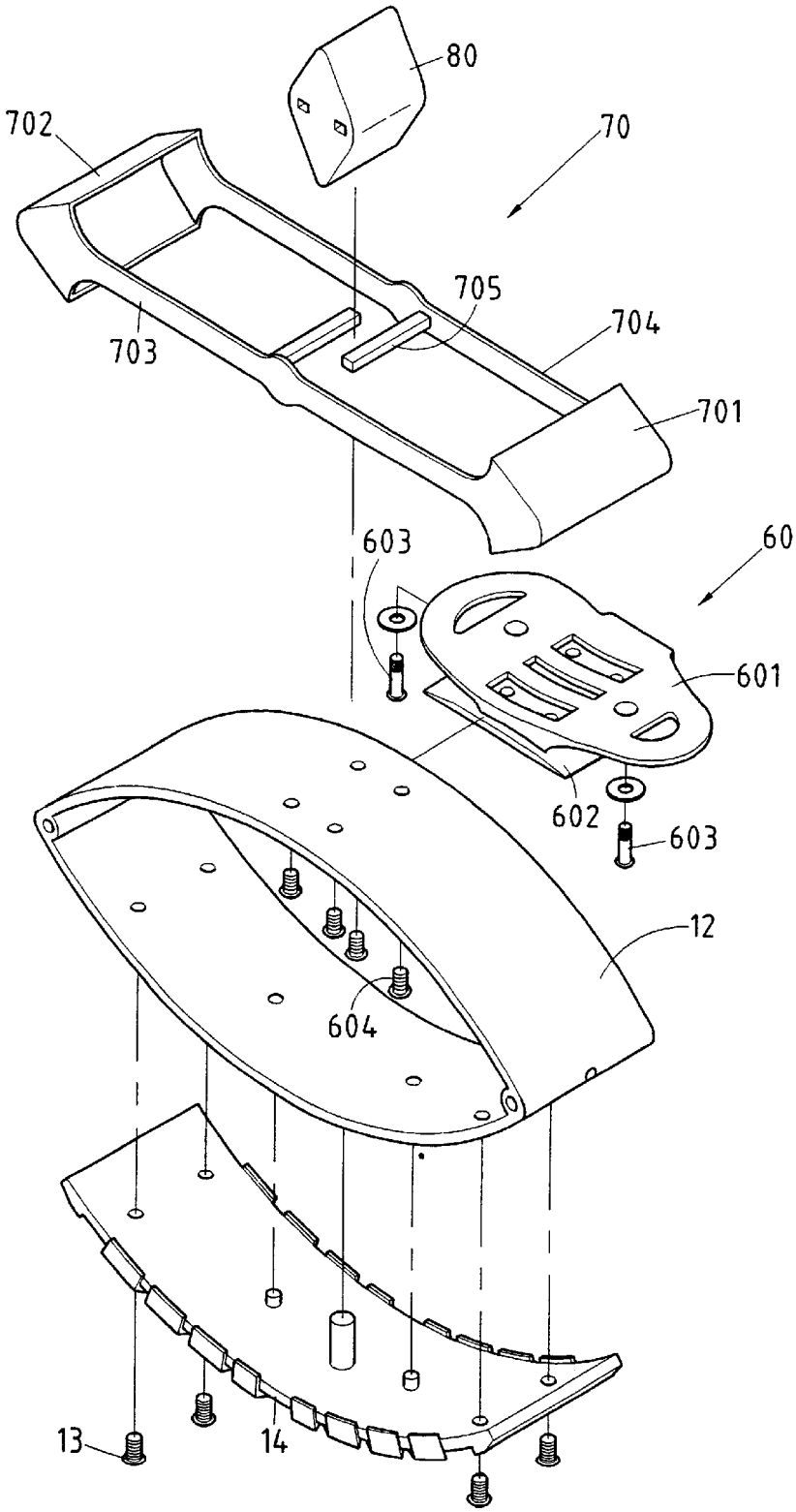
FIG. 2 shows a partial exploded view of the preferred embodiment of the present invention.
Figure 3:
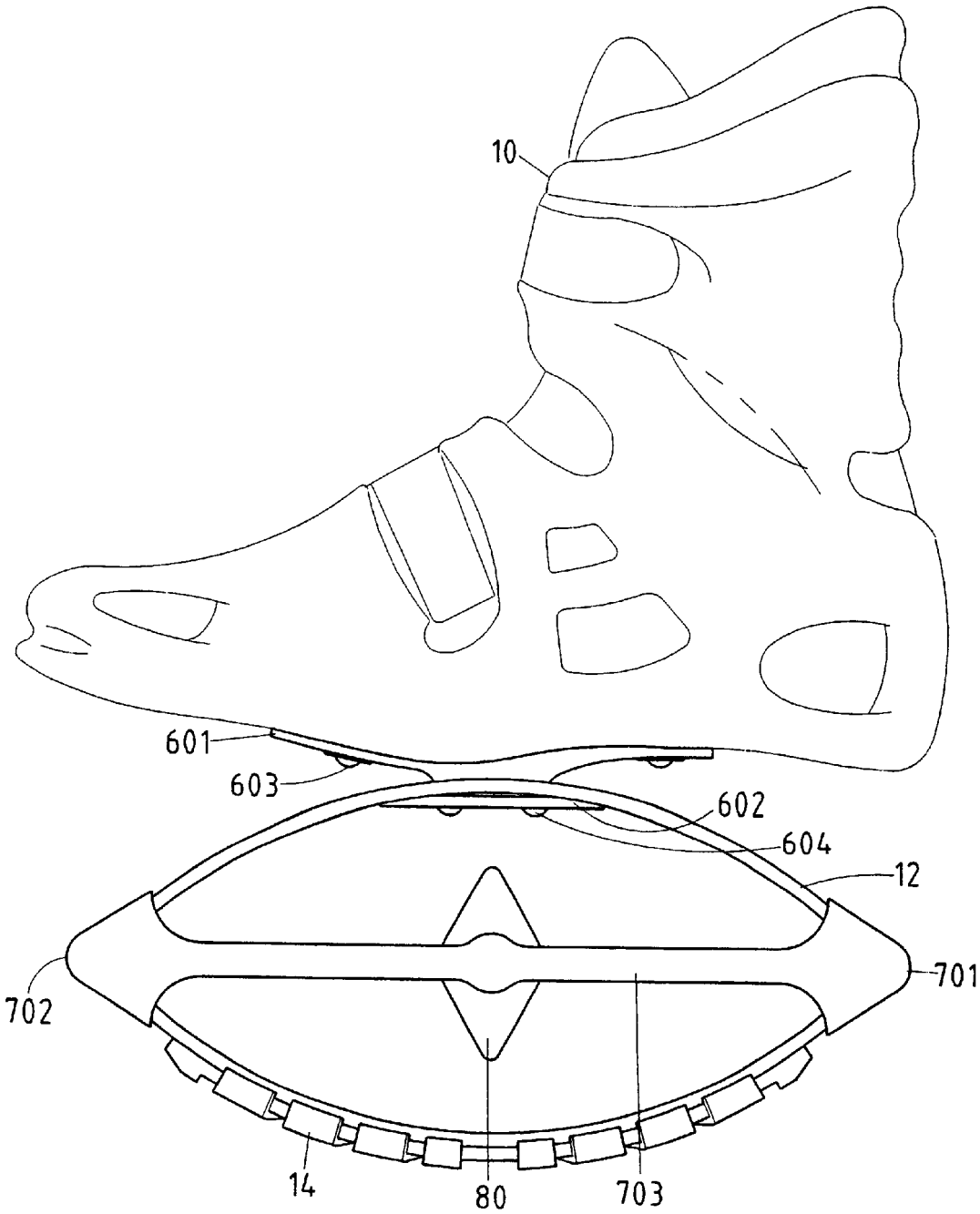
FIG. 3 shows a side schematic view of the preferred embodiment of the present invention.

As shown in FIGS. 1, 2, and 3, a springy sports shoe of the preferred embodiment of the present invention comprises a boot 10, which is provided in a sole thereof with a fastening body 60. The fastening body 60 is used to fasten a springy body 12 to the sole of the boot 10. The fastening body 60 is provided in the underside thereof with a skidproof body 14 fastened thereto by a plurality of fastening bolts 13. The preferred embodiment of the present invention is characterized by the fastening body 60 which is formed of an upper body 601 and a lower body 602. There is a receiving space (not shown in the drawings) located between the upper body 601 and the lower body 602. The upper body 601 is fastened to the sole of the boot 10 by a plurality of fastening bolts 603, whereas the lower body 602 is fastened to the top of the springy body 12 by a plurality of fastening bolts 604. The springy body 12 is provided between the two longitudinal ends thereof with an elastic body 70 which is made of an elastic plastic material and is provided in the longitudinal ends thereof with a covering shell 701 (702) for covering both longitudinal ends of the springy body 12. The elastic body has two longitudinal sides 703 and 704, which are made of an elastic material and are provided in the midsegment thereof with an insertion base 705 for retaining a cushioning body 80.

The fastening of the fastening body 60 to the sole of the boot 10 and the fastening of the fastening body 60 to the springy body 12 are done independently. In other words, the upper body 601 of the fastening body 60 is fastened to the sole of the boot 10 to a plurality of the fastening bolts 603. In the meantime, the lower body 602 of the fastening body 60 is fastened to the springy body 12 by a plurality of the fastening bolts 604. As a result, the fastening body 60 is secured to the sole of the boot 10 even at the time when the springy body 12 is deformed.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A springy sports shoe comprising a boot having a sole said sole fastened to a springy body by a fastening body, said springy body provided in an underside thereof with a skidproof body fastened thereto such that said skidproof body makes contact with the ground at the time when said sports shoe is in action; wherein said fastening body comprises an upper body, a lower body, and a receiving space located between said upper body and said lower body, said upper body being fastened to the sole of said boot by a plurality of fastening bolts, said lower body being fastened to said springy body by a plurality of fastened bolts, said springy body being provided with an elastic body of an elastic plastic material whereby said elastic body is provided with two insertion bars for retaining a cushioning body.

* * * * *